United States Patent [19]

Nishikawa

[11] Patent Number: 4,518,248

[45] Date of Patent: May 21, 1985

[54] APPARATUS FOR FORMING IMAGE BY DEVELOPING CHARGE LATENT IMAGE WITH TWO COMPONENT DRY DEVELOPING AGENT

[75] Inventor: Masaji Nishikawa, Hachioji, Japan

[73] Assignee: Olympus Optical Company Limited, Tokyo, Japan

[21] Appl. No.: 502,703

[22] Filed: Jun. 9, 1983

[30] Foreign Application Priority Data

Jun. 10, 1982 [JP] Japan ..... 57-98409

[51] Int. Cl.[3] ..... G03G 15/08

[52] U.S. Cl. ..... 355/15; 355/3 DD

[58] Field of Search ..... 355/15, 3 DD, 14 D; 118/652; 430/125

[56] References Cited

U.S. PATENT DOCUMENTS

| | | | |
|---|---|---|---|
| 3,552,850 | 1/1971 | Royka et al. | 355/15 |
| 4,111,545 | 9/1978 | Meltzer | 355/15 |
| 4,140,388 | 2/1979 | Ikesue | 355/15 |
| 4,145,137 | 3/1979 | Sunaga et al. | 355/15 |
| 4,158,498 | 6/1979 | Ohmori | 355/15 |
| 4,174,172 | 11/1979 | Lane | 355/15 |
| 4,218,132 | 8/1980 | Iwai et al. | 355/15 |
| 4,284,345 | 8/1981 | Sugiyama et al. | 355/15 |
| 4,357,098 | 11/1982 | Endo | 355/15 |

*Primary Examiner*—A. C. Prescott

*Attorney, Agent, or Firm*—Fleit, Jacobson, Cohn & Price

[57] ABSTRACT

An electrophotographic copying machine having a photosensitive drum is disclosed. Around the drum there are arranged a corona charger for uniformly charging the drum, an optical system for projecting an image of a document onto the uniformly charged drum to form an electrostatic charge latent image, a magnetic brush developing device for developing the latent image with a two component dry developing agent to form a toner image, a transferring device for transferring the toner image onto a record paper to form a duplicated copy, and a cleaning blade for collecting a residual toner on the drum to form a toner accumulation. When the cleaning blade is separated from the drum, the toner accumulation on the drum is transported toward the developing device as the drum continues to rotate. Just before the toner accumulation arrives at the developing device, the toner accumulation is collected by a toner scraper in the form of a thin plate into a toner hopper. The toner collected in the toner hopper is supplied again into the developing device.

11 Claims, 6 Drawing Figures

APPARATUS FOR FORMING IMAGE BY DEVELOPING CHARGE LATENT IMAGE WITH TWO COMPONENT DRY DEVELOPING AGENT

BACKGROUND OF THE INVENTION

The present invention relates to an apparatus for forming images comprising an electrostatic charge retentive member arranged rotatably, means for forming an electrostatic latent image on the charge retentive member, means for developing the latent image with a toner of a two component dry developing agent to form a toner image, means for transferring the toner image onto a record paper and means for removing a residual toner on the charge retentive member.

There has been developed an electrophotographic copying machine in which a charge latent image corresponding to a document image is formed on a rotatable photosensitive drum, the latent image is developed with a two component dry developer including toner and magnetic carrier to form a toner image and then the toner image is transferred onto a record paper to form a duplicated copy. In such a copying machine, after the toner image has been transferred onto the record paper, but prior to forming a new latent image for a next duplication, it is necessary to clean the photosensitive drum to remove residual toner on the drum. Heretofore, there have been proposed various kinds of cleaning devices for removing the residual toner such as a fur brush cleaning device, a blade cleaning device and a magnetic brush cleaning device. In the copying machine in which the latent image is developed with the two component dry developer, it is preferable to collect the residual toner on the drum for the recovery. In the fur brush cleaning device, since the residual toner is brushed off the drum and is collected by a filter with the aid of an air flow passing through the filter, the residual toner collected by the filter could not be used again. Further, the fur brush cleaning device is liable to be large in size and complicated in construction, because it requires large and complicated air sucking mechanism and filter. Therefore, the copying machine having such a fur brush cleaning device is also liable to be large in size. Contrary to this, in the blade cleaning device, since a blade made of elastic material such as urethane resin is brought into contact with the photosensitive drum to scrape the residual toner off the drum, the construction can be made rather small and simple. Further, the scraped residual toner can be collected for the recovery. For this purpose, the residual toner scraped off the drum by the blade is once collected in a toner receptacle and then the collected toner is transferred into the developing device by a manual operation or is automatically transported into the developing device by means of a toner transporting means having a special construction such as a flexible screw. However, in the former case, the maintenance becomes cumbersome, because the toner is difficult to handle, and in the latter case, the toner transporting means becomes complicated.

In copying machines having the magnetic brush developing device, the developing device can be commonly used as the magnetic brush cleaning device and the cleaned residual toner is automatically collected in the developing device. Therefore, it is not necessary to effect the special maintenance and to arrange the complicated device for the recovery. In this type of copying machine, the developing device is arranged between a latent image forming station and a transfer station and thus the cleaning and developing operations could not be carried out simultaneously. Therefore, even in case of forming successively a plurality of copies for a document, the photosensitive drum must be rotated by at least two revolutions for each copy and a circumferential length of the drum must be made longer than a length of a record paper. This results in that the copying speed becomes low and the copying machine becomes large in size.

In a U.S. Pat. No. 3,552,850, there has been further proposed a blade cleaning device in which the residual toner collected by a blade can be transported into a cascade developing device without providing any transporting device having a special construction. In this known cleaning device, the blade is arranged movably between two positions, in one position the blade is brought into contact with the photosensitive drum and in the other position the blade is separated from the drum. When the blade is separated from the drum, an accumulation or a mass of the collected residual toner is released from the blade and passes underneath the blade, and then the toner accumulation on the drum is transported to the developing device due to the rotation of the drum. In the above mentioned U.S. Pat. No. 3,552,850, there is further disclosed another embodiment in which the blade is always urged against the drum and two grooves are formed in the drum surface. Then the residual toner accumulated by the blade is collected by the grooves and is transported into the cascade developing device, while the drum continues to rotate.

The blade cleaning device disclosed in the U.S. Pat. No. 3.552,850 may be applied to the copying machine comprising the magnetic brush developing device using the two component dry developer. In this case, the residual toner scraped by the blade and transported to the developing device due to the rotation of the drum is collected into the developing device by means of a magnetic brush. In the magnetic brush developing device, a developing agent consisting of toner and carrier is transported by the rotation of a magnet roller and/or a non-magnetic sleeve. In this case, in order to prevent the developing agent from being separated from the sleeve surface and to mix effectively a newly supplied toner with the developing agent, a small amount of toner must be supplemented uniformly in the course of the duplicating operation. However, if the residual toner is collected by the developing device, it will not be mixed effectively with the existent developing agent and thus there might occur various drawbacks due to local nonuniformity of toner in the developing device. Moreover, a part of the toner collected into the developing device might be separated from the carrier and might be spread out of the developing device.

SUMMARY OF THE INVENTION

The present invention has for its object to provide an apparatus for forming images in which the above drawbacks can be obviated and the residual toner can be effectively collected for the recovery by means of a simple and small cleaning device, while the collected toner does not affect an existent developing agent in a developing device.

According to the invention, an apparatus for forming an image by developing an electrostatic charge latent image with a two component dry developing agent comprises means including an electrostatic charge retentive member arranged rotatably;

means for forming an electrostatic charge latent image on the charge retentive member;

means for developing the charge latent image with a two component dry developing agent to form a toner image on the charge retentive member and having a toner hopper for storing a toner;

means for transferring the toner image onto a record paper;

means having a cleaning blade selectively brought into contact with the charge retentive member for collecting a residual toner remained on the charge retentive member after transferring the toner image onto the record paper to form a toner accumulation;

means for separating the cleaning blade from the charge retentive member to allow a passage of the toner accumulation underneath the cleaning blade; and means for removing the toner accumulation from the charge retentive member into the toner hopper of the developing means.

DESCRIPTION OF THE PREFERRED EMBODIMENTS

Figure 1:
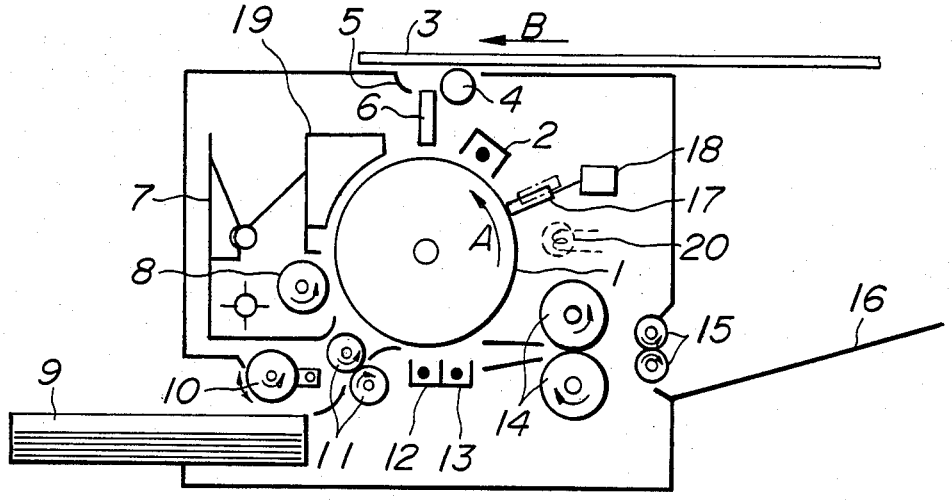
FIG. 1 is a schematic view showing one embodiment of an electrophotographic copying machine comprising the image forming apparatus according to the invention.

FIG. 1 is a schematic view showing an embodiment of the image forming apparatus according to the invention. In the present embodiment, the apparatus is constructed as an electrophotographic copying machine. In FIG. 1, when a duplicating operation is started, a photosensitive drum 1 is rotated in a direction shown by an arrow A and is uniformly charged by a corona charger 2. A document to be duplicated is placed on a document table 3 and is moved in a direction B. The document is illuminated by an illumination lamp 4 and a reflecting mirror 5 and an image of document is projected upon the drum 1 by means of a fiber lens array 6 to form an electrostatic charge latent image corresponding to the document image. The latent image on the drum 1 is developed with a toner in a two component dry developing agent by means of a magnetic brush developing device 7 having a magnetic brush roller 8. A toner image thus developed is transferred onto a record paper which is contained in a paper cassette 9 and fed by a pick-up roller 10 and feed rollers 11. At a transferring station there is provided a transferring corona charger 12. After the toner image has been transferred onto the record paper, the record paper is peeled off the drum by means of a peeling corona charger 13 and a peeling claw not shown and is further supplied to fixing rollers 14 at which the toner is fixed onto the record paper. The record paper is then discharged onto a copy tray 16.

After transferring, on the photosensitive drum 1 there is remained a residual toner. In order to remove the residual toner, there is arranged a cleaning blade 17 made of elastic material such as urethane rubber. The blade 17 is arranged movably with respect to the drum surface and is separated from the drum 1 by means of a blade driving device 18 such as a solenoid. There is further provided a toner collecting device 19 at a position immediately upstream with respect to the magnetic brush roller 8 viewed in the rotational direction A of the drum 1. The toner collecting device 19 serves to collect the residual toner out of the drum 1. At an upstream position with respect to the blade 17, it is preferable to arrange an erasing lamp 20 shown by a broken line. This erasing lamp may be replaced by an AC corona charger.

Figure 2A:
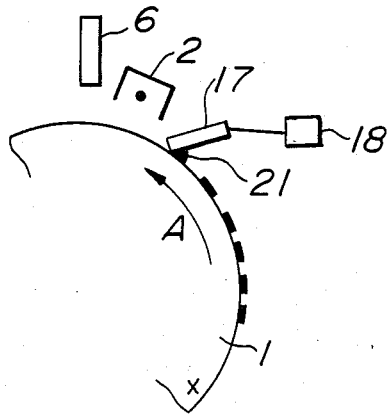
FIGS. 2A and 2B are schematics explaining an operation of a cleaning blade according to the invention.
Figure 2B:
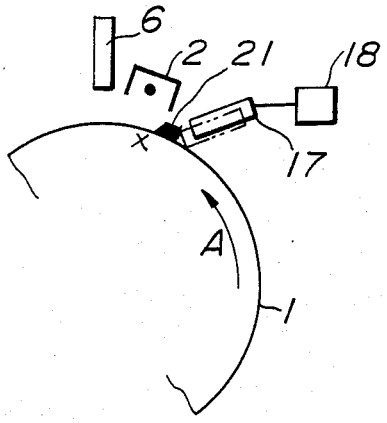

Now the operation of the cleaning blade will be explained with reference to FIGS. 2A and 2B. In these figures, a mark x denotes a rear edge of an area on the drum 1 over which the cleaning should be effected. When the blade 17 is brought into contact with the drum 1, the residual toner remained on the drum surface is collected by the blade 17 and a toner accumulation 21 is formed in a space surrounded by the blade 17 and drum surface. After the rear edge of the area to be cleaned shown by the mark x has passed through the blade 17, the blade driving device 18 is actuated to separate the blade 17 from the drum surface as shown in FIG. 2B. Then the toner accumulation 21 passes underneath the blade 17 and is transported toward the developing device as the drum continues to rotate.

The toner accumulation 21 is liable to be easily removed from the drum 1, because the toner accumulation 21 is formed as a thick layer, in which an air has been contained and an electrostatic atractive force is not generated between the toner accumulation and drum 1. Therefore, the toner accumulation 21 can be easily removed from the drum 1 by the toner collecting device 19. This results in that the toner collecting device 19 can be formed simply. For instance, the toner collecting device 19 may comprise a simple scraper which is brought into contact with the drum 1 as will be explained hereinafter. The scraper may be slightly separated from the drum surface. It should be noted that even if the toner accumulation 21 may not be completely removed by the scraper, any residual part of toner accumulation can be effectively removed by the magnetic brush developing device.

Figure 3:
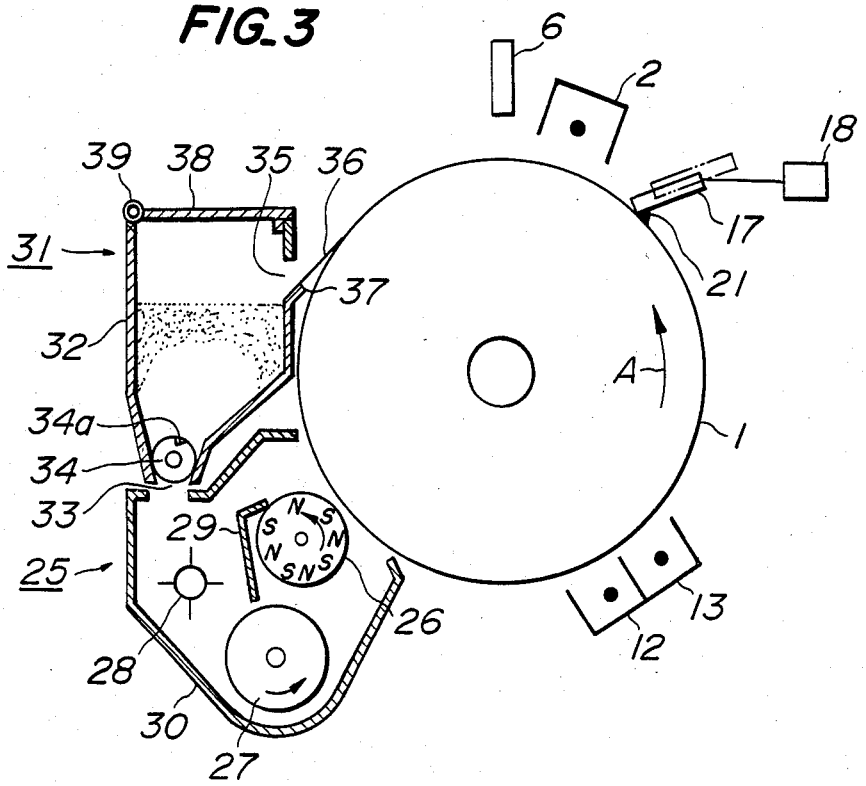
FIG. 3 is a schematic view showing one embodiment of a toner collecting device according to the invention.

FIG. 3 is a schematic view showing an embodiment of the toner collecting device according to the invention. A developing device 25 comprises a developing magnet roller 26 on which a magnetic brush is formed, a conveying magnet roller 27, an agitating vane 28, a scraper 29 for separating the magnetic brush from the magnet roller 26 and a housing 30. Above the developing device 25 is arranged a toner hopper 31 comprising a housing 32 having an outlet 33 and a toner supply roller 34 rotatably arranged at the outlet 33 and having a step **34*a* for supplying a given amount of toner into the developing device 25 each time the roller 34 rotates by one turn. There is further formed a toner inlet 35 in the side wall of housing 32 which faces the photosensitive drum 1 and a toner scraper 36 is secured to an inclined portion 37 formed at a lower wall of inlet 35. The front edge of the scraper 36 is brought into contact with the drum 1 with a small contact force. The scraper may be separated from the drum by a small distance. In order to prevent the scraper 36 from injuring the drum surface, the scraper is formed by a thin film of resilient material such as polyester resin, e.g. polyethylene terephthalate, other resins, stainless steel, phosphor bronze and fluorine rubber. It is preferable to taper the scraper in such a manner that its thickness becomes smaller toward its front edge. Moreover, if the scraper 36 has a turn over front edge which might be produced during the manufacture, it is preferable to arrange the scraper in such a manner that the turn over portion situates opposite to the drum 1 or to remove the turn over portion by grinding or etching. In case of removing the drum 1, the scraper 36** may be retired from the drum.

As the drum 1 rotates in the direction A, the toner accumulation 21 is transported toward the toner collecting device and is scraped off the drum by means of the toner scraper 36 into the toner hopper 31. In this manner, the residual toner is effectively collected in the toner hopper 31 for the recovery. The toner thus collected is supplied into the developing device 25 and is mixed with the developing agent therein. In FIG. 3, a top opening of the hopper housing 32 may be closed by a lid 38 journalled to the housing 32 by a hinge 39.

Figure 4:
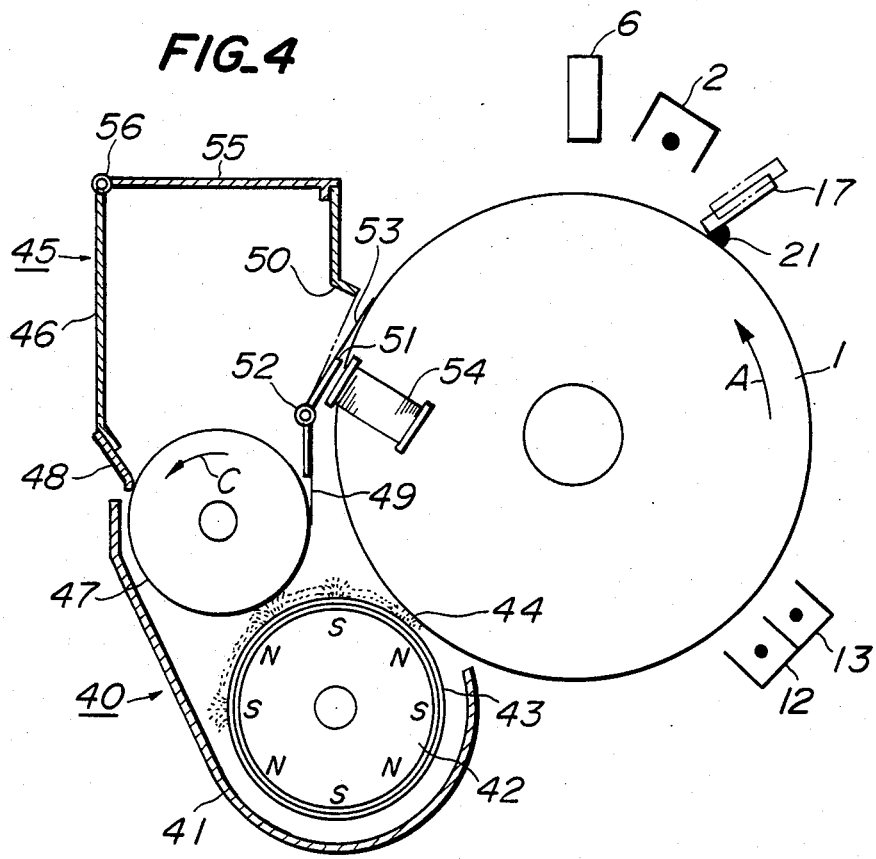
FIG. 4 is a schematic view illustrating another embodiment of the toner collecting device.

FIG. 4 is a schematic view showing another embodiment of the toner collecting device according to the invention. A developing device 40 comprises a housing 41, a magnet roller 42, and a non-magnetic sleeve 43. A magnetic brush 44 of a two component developing agent is formed around the sleeve 43 by a magnetic force. The magnetic brush 44 is rotated by rotating the magnet roller 42 and/or sleeve 43. Above the developing device 40 is arranged a toner hopper 45 comprising a housing 46 having a lower outlet in which a toner supply roller 47 is rotatably arranged. In the outer surface of toner supply roller 47 are formed fine depressions having a dimension substantially equal to a diameter of a toner. The toner supply roller 47 is rotated in a direction illustrated by an arrow C. To the housing 46 is secured a blade 48 whose front edge is urged against the roller 47 with a relatively strong force. Further a shielding plate 49 is arranged between the housing 46 and roller 47. The shielding plate 49 formed by a thin plate of plastics or metal serves to prevent the toner contained in the hopper from dropping into the developing device through a space between the housing 46 and roller 47 and is urged against the roller 47 with a small force. In the side wall of housing 46 which faces the drum 1 is formed a toner inlet 50. At the inlet 50 there is arranged a scraper holder 51 journalled to the housing 46 by means of a hinge 52 and a scraper 53 is secured to the holder 52. The scraper 53 has such a dimension that it can completely cover the inlet opening 50. The holder 51 is biased by a spring (not shown) to rotate in such a direction that the the scraper 53 normally closes the inlet 50. There is further provided an electromagnet 54 for attracting the holder 51 made of magnetic material to open the inlet 50 as well as to bring the scraper 53 into contact with the drum 1. It is not always necessary to make the holder 51 of magnetic material, but a piece of magnetic material may be secured to the holder. An upper opening of the hopper 45 is closed by a lid 55 journalled to the housing 46 by means of a hinge 56.

The residual toner on the drum 1 is collected by the blade 17 which is brought into contact with the drum and after cleaning the latent image region the blade 17 is once separated from the drum as shown by a chaine line. Then the toner accumulation 21 is transported on the drum 1 toward the toner collecting hopper 45. Before the toner accumulation arrives at the hopper 45, the electromagnet 54 is energized to bring the scraper 53 into contact with the drum 1. Therefore, the toner accumulation 21 is collected by the scraper 53 out of the drum surface. After that the electromagnet 54 is deenergized and the scraper 53 is separated from the drum 1. During this rotational movement of the scraper 53, any toner on the scraper can be effectively dropped into the toner hopper 46. In this manner, the residual toner is not remained on the scraper, otherwise the collection of toner is prevented due to a possible stack of toner on the scraper. The toner collected by the scraper 53 into the hopper 45 is then supplied to the developing device 40 in accordance with the rotation of the toner supply roller 47. When the toner on the roller 47 passes through the blade 48, it is charged due to the triboelectrification. It should be noted that the scraper 53 may be rotated by means of any other devices than the electromagnet 54. For instance, the scraper may be moved by a suitable cam mechanism or a rotary solenoid.

Figure 5:
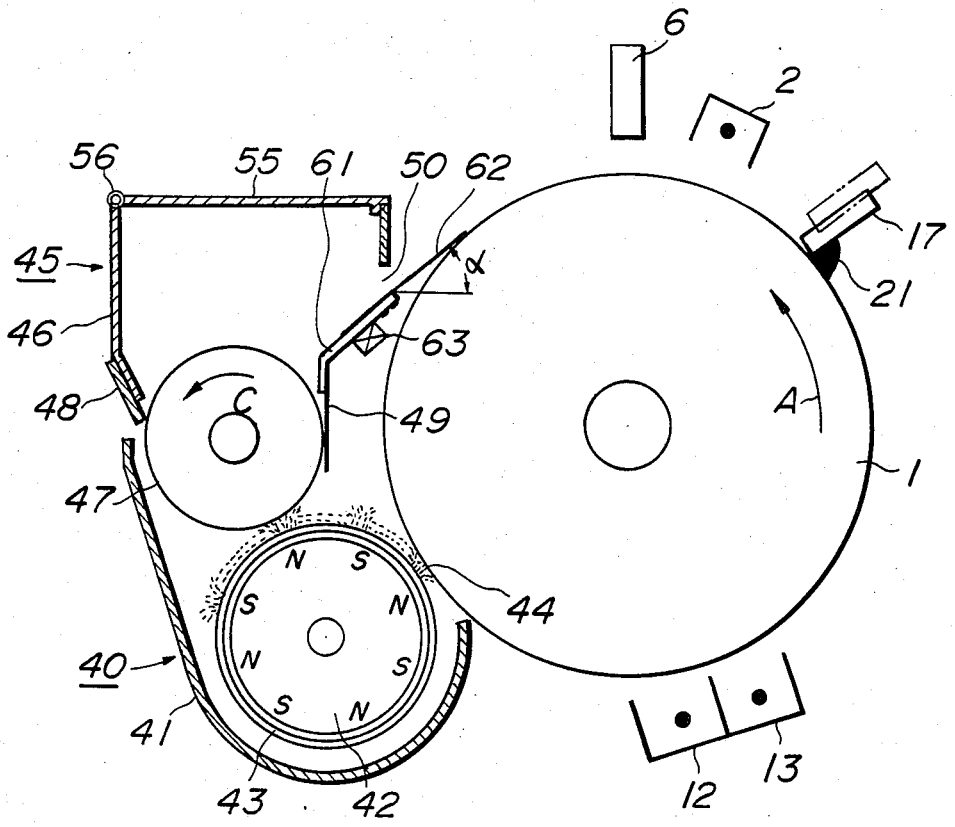
FIG. 5 is a schematic view depicting still another embodiment of the toner collecting device according to the invention.

FIG. 5 is a schematic view showing still another embodiment of the toner collecting device according to the invention. The toner collecting device of this embodiment differs from that shown in FIG. 4 only in the construction of the toner inlet 50 and the toner scraping device. That is to say, a lower wall 61 of the toner inlet 50 is inclined upwardly and a scraper 62 is secured to this inclined lower wall 61. To the toner edge is further provided a vibrating device 63 for producing a vibration subjected to the scraper 62 via the wall 61. The vibrating device 63 may be formed by an electrostrictive element such as a piezo element or an electromagnet to which an A.C. voltage is applied from an A.C. voltage source. Further, the scraper may be subjected to mechanical shock or vibration by utilizing the rotation of the toner supply roller 47, the magnet roller 42 or the sleeve 43.

The toner accumulation 21 formed on the drum 1 is transported toward the toner collecting hopper 45 in accordance with the rotation of the drum and is separated from the drum 1 by the scraper 62 and the toner thus separated from the drum is dropped into the hopper 45 via the scraper 62. If an inclination angle $\alpha$ of the scraper 62 with respect to the horizontal, the toner is hardly introduced into the hopper 45 only due to the gravitational force. However, according to the present embodiment, since the scraper 62 is vibrated by the device 63, the toner on the scraper can be effectively descended into the hopper 45.

The present invention is not limited to the embodiments explained above, but many modifications can be conceived by those skilled in the art within the scope of the invention. For instance, the charge retentive member may be formed by a photosensitive endless belt. Further the image forming apparatus according to the invention can be applied not only to the electrophotographic copying machine, but to various type of electrostatic recording apparatuses. For instance, a charge latent image may be directly formed on an insulating record medium by means of a multi-stylus electrode or a photosensitive screen. Then the latent image is developed with the toner and a toner image is transferred onto a record paper.

What is claimed is:

1. An apparatus for forming an image by developing an electrostatic charge latent image with a two component dry developing agent comprising means including an electrostatic charge retentive member arranged rotatably;

means for forming an electrostatic charge latent image on the charge retentive member;

means for developing the charge latent image with a two component dry developing agent to form a toner image on the charge retentive member and having a toner hopper for storing a toner;

means for transferring the toner image onto a record paper;

means having a cleaning blade selectively brought into contact with the charge retentive member for collecting a residual toner remained on the charge retentive member after transferring the toner image onto the record paper to form a toner accumulation;

means for separating the cleaning blade from the charge retentive member to allow a passage of the toner accumulation underneath the cleaning blade; and means for removing the toner accumulation from the charge retentive member into the toner hopper of the developing means.

2. An apparatus according to claim 1, wherein said means for removing the toner accumulation from the charge retentive member comprises a scraper in the form of a thin plate having one edge connected to a toner inlet formed in the hopper and having the other edge extended toward the charge retentive member.

3. An apparatus according to claim 2, wherein said other edge of the scraper is brought into contact with the charge retentive member.

4. An apparatus according to claim 2, wherein said other edge of the scraper is slightly separated from the charge retentive member.

5. An apparatus according to claim 2, wherein said one edge of the scraper is rotatably connected to the toner inlet and the toner accumulation removing means further comprises means for rotating the scraper between a first position in which the scraper can collect the toner accumulation from the charge retentive member and a second position in which the scraper closes the toner inlet of the hopper.

6. An apparatus according to claim 5, wherein said scraper rotating means comprises an electromagnet and a magnetic member formed integrally with the scraper.

7. An apparatus according to claim 6, wherein said magnetic member is formed by a holder for supporting the scraper.

8. An apparatus according to claim 2, wherein said toner accumulation removing means further comprises means for vibrating the scraper.

9. An apparatus according to claim 8, wherein said vibrating means comprises an electrostrictive element coupled with the scraper.

10. An apparatus according to claim 2, wherein said scraper is made of elastic material.

11. An apparatus according to claim 2, wherein said scraper is formed by a tapered thin plate.

* * * * *